US005231723A

United States Patent [19]

White et al.

[11] Patent Number: 5,231,723

[45] Date of Patent: Aug. 3, 1993

[54] FOOT SIZING METHOD AND LAST PRODUCED THEREBY

[75] Inventors: Jay P. White; Margaret J. Kolb, both of Bend, Oreg.

[73] Assignee: Foot Image Technology, Inc., Bend, Oreg.

[21] Appl. No.: 840,010

[22] Filed: Feb. 24, 1992

Related U.S. Application Data

[62] Division of Ser. No. 416,624, Oct. 3, 1989, Pat. No. 5,123,169.

[51] Int. Cl.[5] ..... A43D 3/00

[52] U.S. Cl. ..... 12/133 R; 12/146 L; 33/3 R; 33/650

[58] Field of Search ..... 33/3 R, 3 A, 3 B, 3 C, 33/4, 5, 6, 650, 515; 12/133 R, 1 R, 146 L; 128/779

[56] References Cited

U.S. PATENT DOCUMENTS

| | | | |
|---|---|---|---|
| 45,748 | 1/1965 | Plumer | 12/133 R |
| D. 174,252 | 3/1955 | Di Piero | 33/3 A |
| 894,524 | 7/1908 | McGowan | 33/3 B |
| 996,910 | 7/1911 | Däuker | 33/3 C |
| 1,130,423 | 3/1915 | Muller | 12/133 R |
| 1,575,646 | 3/1926 | Scholl . | |
| 1,725,021 | 8/1929 | Scholl | 33/3 B |
| 1,725,334 | 8/1929 | Brannock | 33/3 B |
| 1,833,116 | 11/1931 | Krippendorf | 12/133 R |
| 1,858,914 | 5/1932 | Bradley | 33/3 C |
| 1,973,435 | 9/1934 | Hiss | 33/3 B |
| 2,009,471 | 7/1935 | Brauer et al. . | |
| 2,148,650 | 2/1939 | Scholl | 33/3 A |
| 2,176,294 | 8/1940 | Schwartz et al. | 12/133 R |
| 2,327,254 | 8/1943 | Fisher et al. | 33/3 A |
| 2,758,376 | 8/1956 | Ledos | 33/3 C |
| 3,696,456 | 10/1972 | Dunham et al. . | |
| 4,164,815 | 8/1979 | Salomon | 33/3 A |
| 4,412,364 | 11/1983 | Mateó . | |
| 4,454,618 | 6/1984 | Curchod . | |
| 4,538,353 | 9/1985 | Gardner . | |
| 4,594,783 | 6/1986 | Chaumel | 33/4 |
| 4,604,807 | 8/1986 | Bock et al. . | |
| 4,745,290 | 5/1988 | Frankel et al. . | |
| 4,817,222 | 4/1989 | Shafir . | |
| 4,876,758 | 10/1989 | Rolloff et al. . | |

FOREIGN PATENT DOCUMENTS

| | | | |
|---|---|---|---|
| 505596 | 8/1930 | Fed. Rep. of Germany . | |
| 633236 | 7/1936 | Fed. Rep. of Germany | 12/133 R |
| 2417168 | 11/1974 | Fed. Rep. of Germany . | |
| 2720259 | 11/1977 | Fed. Rep. of Germany . | |
| 36884 | 10/1935 | Netherlands . | |
| 285763 | 1/1953 | Switzerland . | |
| 1255-852-A | 9/1986 | U.S.S.R. . | |
| 1414298 | 11/1975 | United Kingdom . | |

OTHER PUBLICATIONS

William A. Ross, *Footwear News*, entitled "The 14--Point Fit Test", dated Jul. 1987, 2 pages (Exhibit A).

Jackson Hogen, *Snow Country*, "The Best Boots For the Dollar", dated Aug. 1989, pp. 72–78. (Exhibit B).

Brannock Fitter (Photograph Enclosed), undated, 1 page. (Exhibit C).

Dana Fitter (Photograph Enclosed), undated, 1 page. (Exhibit D).

"The All-Important Last", *American Shoemaking*, Sep. 1988, pp. 49–52. (Exhibit E).

"The Story of Lasts", by Harold R. Quimby, National Shoe Manufacturers Association, Copyright 1948, 32 pages. (Exhibit F).

*Primary Examiner*—William A. Cuchlinski, Jr.
*Assistant Examiner*—Alvin Wirthlin
*Attorney, Agent, or Firm*—Merchant, Gould, Smith, Edell, Welter & Schmidt

[57] ABSTRACT

A last having an outer footwear shaping surface is provided wherein the outer footwear shaping surface is constructed and arranged to have a foot length component corresponding to the length measurement of the foot, a width component corresponding to the width line, and curvature angles corresponding to the curvature angles of the foot. An arch-line component, a heel width component, and a foot volume component may also be provided to correspond with the foot.

8 Claims, 4 Drawing Sheets

FOOT SIZING METHOD AND LAST PRODUCED THEREBY

This is a division of application Ser. No. 07/416,624, filed Oct. 3, 1989, now U.S. Pat. No. 5,123,169 dated Jun. 23, 1992.

TECHNICAL FIELD OF THE INVENTION

The present invention relates generally to a method of foot sizing and more particularly to a foot sizing method which relies on very accurate empirical data. The invention also provides for a last manufactured using the improved foot sizing data collection method.

SUMMARY OF THE INVENTION

A method is provided for accurately sizing a foot. The method comprises the steps of deriving a length measurement from a foot centerline, calculating a width line between medial and lateral portions of the foot or between flexion points, determining an arch-line type, and comparing the angle of curvature of the medial edge and the lateral edge of the foot as measured from a heel point at the base of the heel. Also included in the foot sizing method are calculations of heel width and foot volume. A last structure comprising a surface area shaped according to the measurements of the foot sizing method is also provided.

BACKGROUND OF THE INVENTION

Within the field of foot sizing and footwear manufacture, numerous inaccuracies occur. Indeed, it has been common throughout footwear making history to utilize very few actual measurements of feet during foot sizing and footwear last manufacture. Unfortunately, the resultant lasts and footwear accurately size only a minority of the footwearing population. Not only have sizing problems resulted, but extensive inventory waste and manufacturing inefficiencies have also occurred.

An example of the standard by which foot sizing has typically been accomplished in the past is the widespread use of the Brannock measuring system and device well known to most footwear purchasers. The Brannock system and device merely provides length and width measurements of feet. Such measurements provide very little empirical data regarding the many variables which must be addressed to achieve accurate foot sizing and footwear. Yet the lasts used to manufacture footwear have typically comprised outer surfaces with measurements depending or derived from a Brannock type system.

What has been needed therefore has been a foot sizing method which more accurately sizes and measures feet.

What has been further needed is a last for manufacturing footwear with an outer surface shape utilizing measurements derived from an improved empirical foot sizing method.

Other objects and advantages of the invention will appear from the following detailed description, which, in connection with the accompanying drawings, discloses embodiments of the invention for purposes of illustration only and not for determination of the limits of the invention.

DETAILED DESCRIPTION OF THE INVENTION

As required, detailed embodiments of the present invention are disclosed herein. It is to be understood, however, that the disclosed embodiments are merely exemplary of the invention which may be embodied in various forms. Therefore, specific structural and functional details disclosed herein are not to be interpreted as limiting, but rather as a basis for teaching one skilled in the art to variously employ the present invention in virtually any appropriately detailed system or structure.

Figure 1:
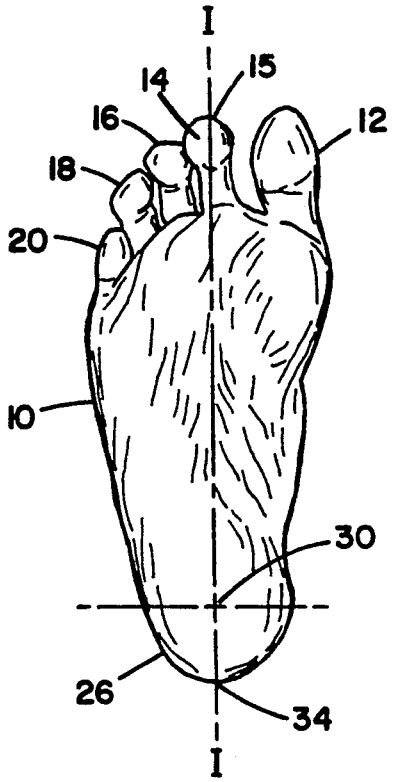
FIG. 1 is a bottom view of a representative human foot illustrating a heel center of mass and a foot centerline.

Referring to FIG. 1, a representative bottom view of a human foot is shown. Human foot 10 in FIG. 1 is representative of a typical human foot. A large toe 12 is accompanied by second toe 14 with a tip 15, third toe 16, fourth toe 18, and fifth toe 20. A great majority of humans have large toe 12 extending beyond the tips of the other toes. However, some humans have second toe 14 extending beyond the tips of other toes, and approximately 5% of humans have third toe 16 extending as the longest toe beyond the tips of any of the other toes. Thus, prior art foot measuring systems which relied on longest toe length as a crucial determinant of foot shape resulted in the incorporation of many unwanted variables due to the nonsymmetrical relation of longest toe length with other measurement components of an accurately measured foot. Further, typical prior art foot measuring systems comprised measuring the longest toe length of a foot and utilizing that measurement in cooperation with a foot width measurement to provide an optimum footwearer size and width. As is only now known and described within the disclosure of this invention, such prior art systems have considerable flaws. For example, prior art foot measuring systems typically involve inter-related parameters. Such inter-related parameters do not provide accurate foot sizing information. This may best be seen by recalling a typical scenario of foot measuring wherein a shoe fitter will-measure the length and width of a wearer's foot. Then the shoe fitter will return to a shoe storeroom to obtain a range of shoes that will be reasonably close to the shape of the measured wearer's foot. Then, the actual "fitting" of the shoe takes place. Indeed, such fitting normally comprises altering either the length or the width of the shoe put on the wearer's feet until the wearer feels most comfortable. Such a procedure is highly inefficient and replete with inadequacies. For example, this procedure fails to account for the pronation tendencies of a wearer's feet. Indeed, this is complicated by the fact that a typical shoe wearer will only wear a pair of shoes in a shoe store for a relatively short amount of time prior to the purchase decision. Although a length or a width combination may appear to provide a comfortable shoe for the wearer, it might only be providing acceptable support in one or two locations, rather than throughout the entire foot. Often, purchasers do not select shoes with the proper arch support due to the short amount of test time in the shoes, and for other reasons.

Yet another example of the inter-related problem of prior art foot measuring may be shown by comparing a typical size 9D shoe surface area with a typical size 10C shoe surface area. Using the Brannock type measuring system sizes, the shoe surfaces may actually be virtually identical in size. Conversely, a customer might believe that a 10D size shoe and a 9D size shoe are essentially the same width, but they are in fact not. Rather, these two shoes under the Brannock system could be several millimeters in width different.

The present foot sizing invention comprises a method of empirically measuring a foot, or a plurality of feet, which results in more accurate empirical measurements or scalers for use in designing the shape of a last for footwear which will accurately support and protect the entire foot being measured. Alternately, this method is quite useful in sizing feet for off the shelf fit of existing inventory. This latter use imparts greatly needed efficiency to the manufacturing, distribution, and fitting processes.

Foot 10 is representative of a foot to be measured. Foot 10 comprises a heel area 26 with a center of mass 30. Center of mass 30 generally corresponds with the center of the heel area 26 but may differ slightly in individual instances. A foot centerline, shown as line I—I, is created and extends from the middle of second toe 14 through center of mass 30 of heel area 26. The extension of foot centerline I—I intersects the end of the heel at heel point 34. As will be further discussed herein, the heel width measured across the heel (through the center of mass 30) and centerline I—I are integral to determining length and width components of the present invention.

Figure 2:
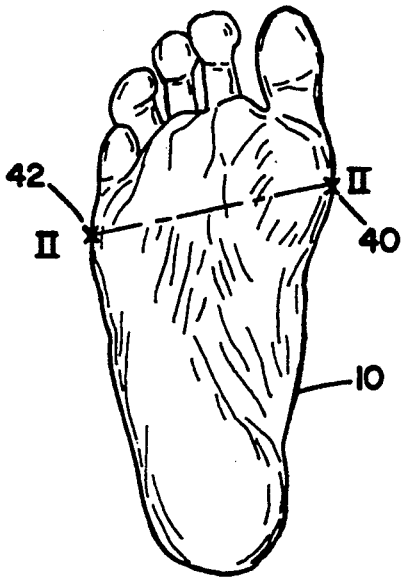
FIG. 2 is a bottom view of a foot illustrating a width component line.

Referring to FIG. 2, foot 10 is shown with line II—II extending between the medial point 40 at the widest part of the ball of foot 10, and lateral point 42 at the widest part of foot 10. More particularly, line II—II comprises a foot width line located in a flexion area extending between the flexion point proximate the widest lateral edge of the foot and proximate the flexion point at the widest medial edge of the foot. It should be pointed out that typical foot measurements in the past have merely included wall to wall foot width measurements. Such foot width measurements are inadequate in defining the actual foot dynamics and needs. The above referred to flexion area comprises the plurality of metatarsal heads of the five metatarsal bones in the foot. Thus, this flexion area, which is sometimes labelled the "metatarsal well" should comprise the area of greatest interest to foot sizing methodologists. As can be appreciated, the line between the widest part of the foot may be oriented quite differently than a line connecting the first metatarsal head area and the fifth metatarsal head area, such as line II—II (See for example, FIG. 9, line III—III). This is a very important consideration in comfortable footwear design due to the critical sensitivity of the foot, the balance vectors derived from this flexion area, and long term foot support characteristics of the footwear derived from these measurements. Thus, it is recognized that width component line II—II extends between the flexion point located at the ball of foot 10 and the flexion point at the lateral portion of foot 10.

Figure 3:
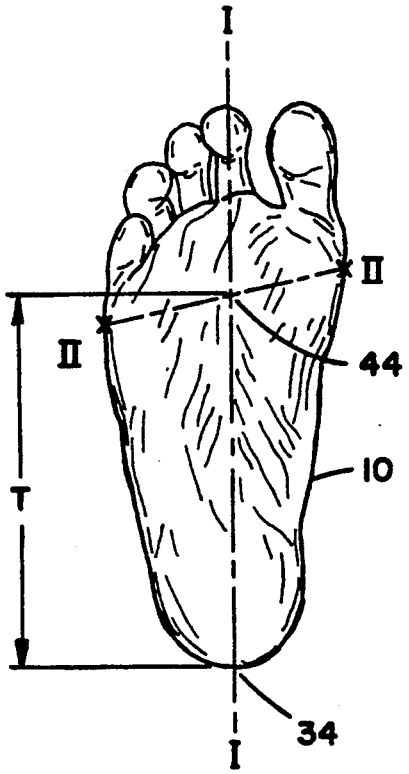
FIG. 3 is a bottom view of a foot illustrating the intersection point of the width component line and the centerline.
Figure 9:
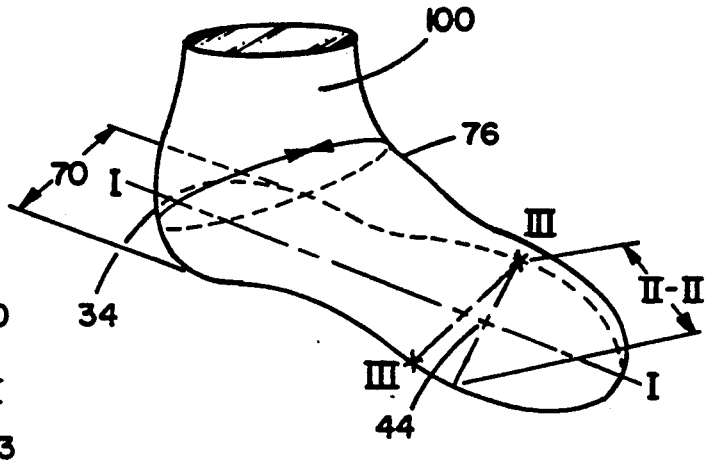
FIG. 9 is a perspective view of a last manufactured with the dimensional scalers of the present invention.

As illustrated in FIG. 3, foot centerline I—I and foot width component line II—II will intersect at a point 44 referred to herein as the T point. Thus, the distance from heel point 34 to T point 44 along foot centerline I—I comprises a distance defined as the T distance, as appropriately labelled on FIG. 3. T point 44 will not always correspond with the center point on a line measured between the wall-to-wall width of foot 10, but rather will always represent the point of intersection between the herein described foot centerline I—I and the width component line II—II. FIG. 9 best illustrates the difference between width component line II—II and the line III—III denoting the wall-to-wall foot width normally measured by systems in the prior art.

Figure 4A:
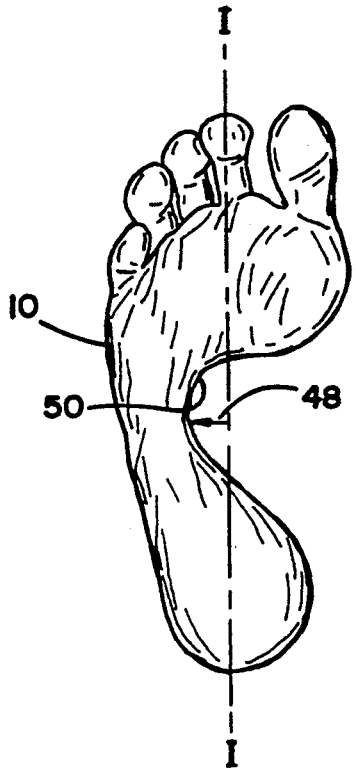
FIG. 4*a* is a bottom view of a foot illustrating the measurement vectors extending from the foot centerline to the arch-line.
Figure 4B:
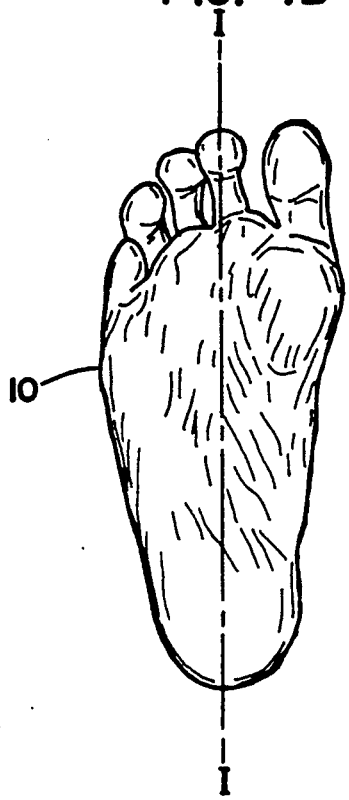
FIG. 4*b* is a bottom view of a foot illustrative of a flat foot.
Figure 4C:
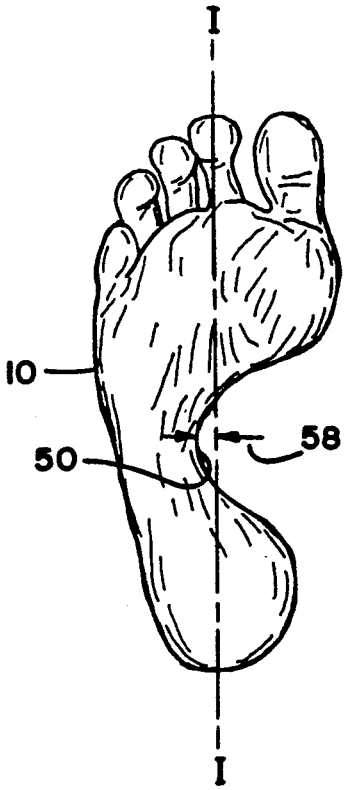
FIG. 4*c* is a bottom view of a foot illustrative of a standard arch-line foot.
Figure 4D:
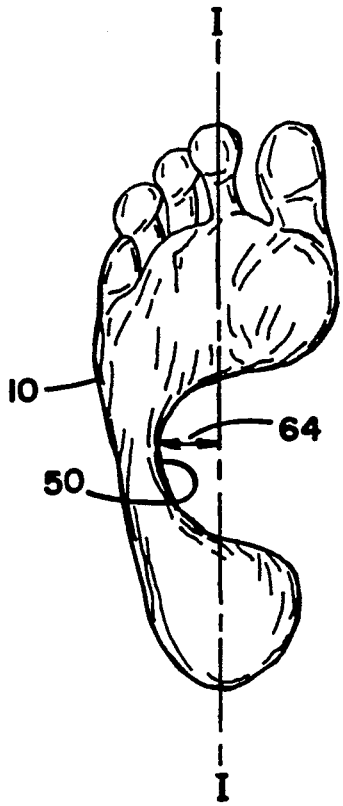
FIG. 4*d* is a bottom view of a foot illustrative of a high arch-line foot.

FIGS. 4*a*, 4*b*, 4*c*, and 4*d* each illustrate a foot shape bottom surface. Each of these figures represents the various surfaces on the bottom of representative human foot 10 which may be in contact with a walking surface or, more particularly, the figures show the impression of a foot as it appears to a planar measuring surface pressed lightly against the bottom of foot 10. Therefore, what is shown in FIG. 4*a* is a bottom surface of foot 10 having a superimposed foot centerline I—I and vector 48 extending perpendicular to foot centerline I—I to indicate the arch-line of foot 10. In other words, arch-line 50 comprises the line delineating a surface substantially co-planar to the remainder of the walking surface or bottom of foot 10. The length of perpendicular vectors extending between foot centerline I—I to arch-line 50 determine whether foot 10 comprises an arch with a flat, standard, or high arch-line. It is understood that the values of the distance between foot centerline I—I and arch-line 50 may comprise a composite value or a value assigned when compared with a series of model distances, areas, or arch-line shapes. FIG. 4*b* illustrates representative foot 10 having no discernable arch-line 50 and thus would be considered a flat foot. However, as shown in FIG. 4*c*, the distance between foot centerline I—I and arch-line 50 represented by vector 58 represents a standard arch-line more common on-human feet 10. Yet referring to FIG. 4*d*, a very high arch-line is shown as represented by the vector 64. In addition to determine the arch-line type as either a type 1 (high arch type) or a type 2 (standard arch type) or type 3 (flat arch type) by means of vector analysis, it is appreciated that an area analysis may also be utilized. For example, a determination of the area contained within the lines formed by foot centerline I—I and arch-line 50 could also be utilized for this analysis. A comparison of actual area size versus model area size is contemplated within this invention to provide an arch-line type.

Figure 5:
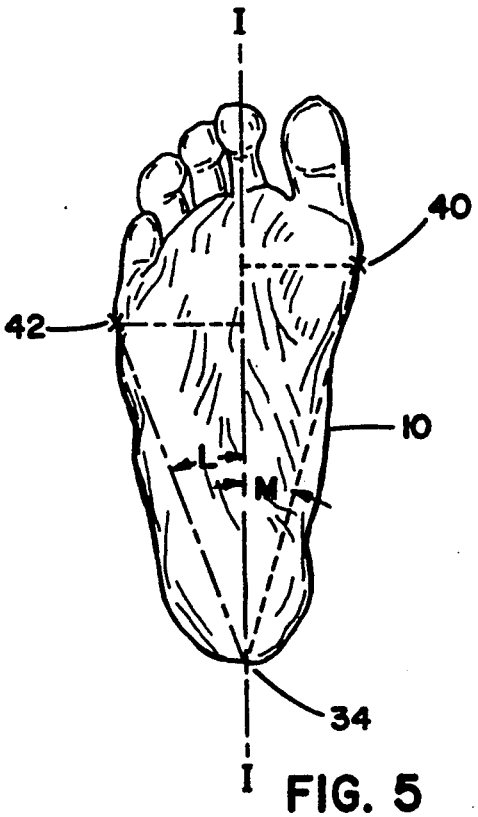
FIG. 5 is a bottom view of a foot with vectors extending at a angle from the foot centerline to derive curve medial and curve lateral values.

In addition to obtaining length component information, and arch type information, it is important to ascertain the curvature characteristics of each foot being measured. Referring then to FIG. 5, means for analyzing foot curvatures of foot 10 is shown. As earlier described, foot centerline I—I intersects heel at heel point 34. What is required next is to determine the curvature of foot 10 relative to foot centerline I—I. A preferred means comprises determining one vector each from heel point 34 to lateral point 42 and from heel point 34 to medial point 40. Then, a number of trigonometric relationships may be used to determine foot curvature. However, a preferred means of determining this curvature value is to measure the angles formed between foot centerline I—I and the above described vectors between heel point 34 and medial point 40 and lateral point 42. What is provided, therefore, is a pair of angles as shown in FIG. 5 labelled M and L respectively. Angle M represents the medial curvature of the foot in degrees and angle L represents the lateral curvature of the foot in degrees. Yet another way of expressing these angular values is to designate angle M as CMD and angle L as CLD. By then comparing the values for CMD and CLD, a curvature value may be assigned for use in this preferred sizing and numbering system. For example, preferred numeration analysis comprises comparing CMD and CLD. If CMD is greater than CLD then a value is assigned of 1. Similarly, if CMD equals CLD then the assigned value is 2. If CMD is less than CLD then three options present. The first option arises when the difference between the value of CMD and CLD is less than 0.5°. In this option an assigned value of 3 is preferred. The second option is when the difference between CMD and CLD is between 0.5° and 1.5°. In such case, an assigned value of 4 is preferred. Finally, when the difference between CMD and CLD is greater than 1.5° (and CMD is less than CLD) then a preferred assigned value is 5.

Figure 6:
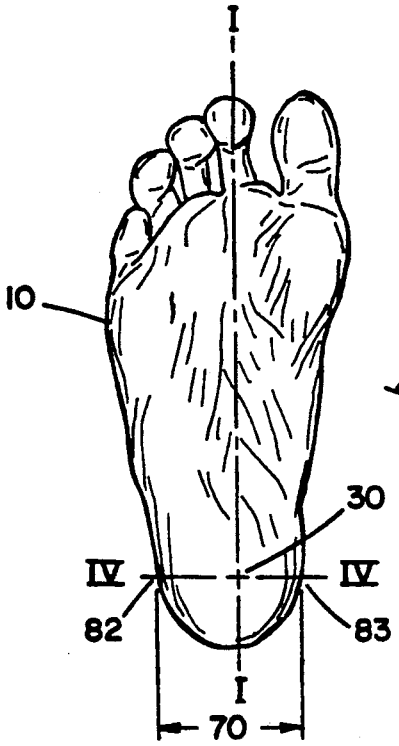
FIG. 6 is a bottom view of a foot illustrating a heel width component.

Referring now to FIG. 6, foot 10 and foot centerline I—I are illustrated. Also shown is heel width component line IV—IV extending substantially perpendicular to foot centerline I—I through center of mass 30. The length of heel width component line IV—IV as shown by length 70 in FIG. 6 thereby provides an additional measurement component for use with the above described foot sizing method. A heel width value or range of values may be assigned to various heel widths.

Figure 7:
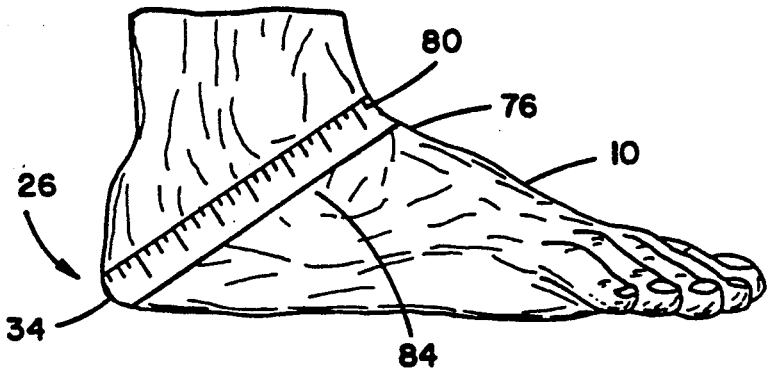
FIG. 7 is a side elevation view of a foot illustrating a peripheral measurement means extending from the heel point laterally up to and beyond the upper instep.

In order to more accurately determine the instep shape and the overall volume requirements of individual feet, a volume measurement is preferably provided. Referring to FIG. 7, a side elevation view of representative human foot 10 is shown in a lateral orientation. In order to overcome prior art deficiencies relating to lack of volume measurements, a preferred volume measurement means comprises measuring the peripheral distance from heel area 26 up and around instep area 76 and then back down the other side of foot 10 resulting in a volume related measurement. More particularly, a measuring means, such as a flexible measurement strip 80 is extended from heel point 34 along the lateral malleolus region 84 up to and across upper instep region 76 and then down along the medial side of foot 10 to heel point 34. The total length of this peripheral measurement provides a value which may be correlated to provide a volume measurement or rating for foot 10. This volume measurement is particularly critical in establishing the instep position and ankle size of foot 10 and contributes greatly to the accuracy of footwear made utilizing these measurements.

Figure 8:
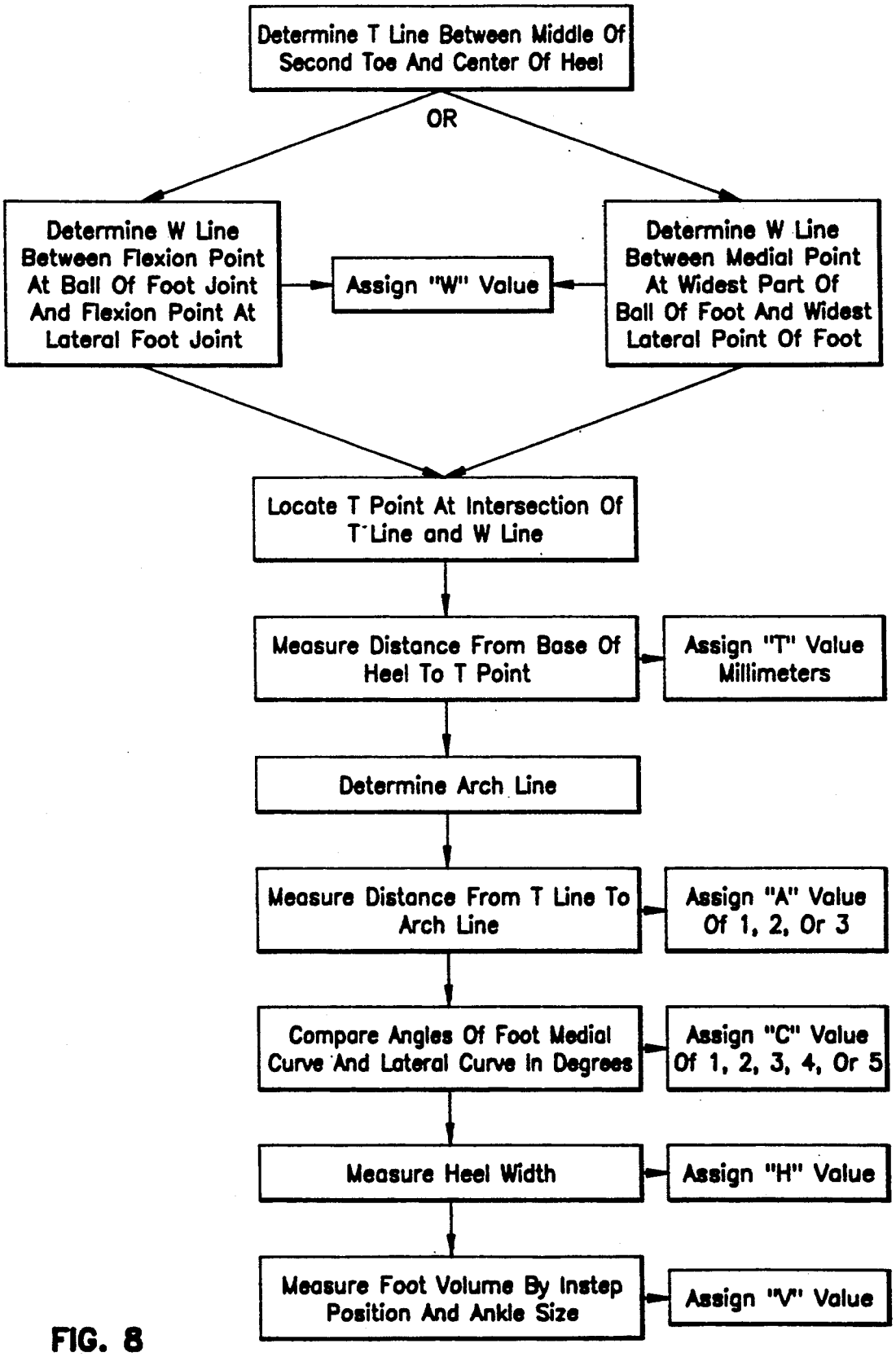
FIG. 8 is a flow diagram of the foot measurement logic for improved foot sizing.

What is also provided therefor is a method for sizing foot 10 comprising several steps. As shown in FIG. 8, the method comprises axially measuring a length component of foot 10 along a length axis aligned between foot centerline I—I extending from heel point 34 at the base of the heel area 26 to the tip 15 of second toe 14. The axial measurement preferably extends from heel point 34 to the intersection with a foot width measuring line, such as foot width component line II—II, shown in FIG. 3. A length measurement value is assigned to this axial measurement in, preferably, millimeters. Next it is necessary to calculate a foot width line extending between the widest part of foot 10 between the flexion points or at foot medial ball 40 and the widest lateral part of foot 10, such as lateral point 42.

Then it is necessary to determine the specific arch-line type from a plurality of arch-line types, and to determine the curvature of the foot. The arch-line type measurement is preferably accomplished by measuring the distance from the foot centerline to the foot arch-line and then comparing the distance to a model distance database to determine a value for the foot arch-line type. It is possible to determine the curvature of foot 10 by comparing the angle of curvature of the medial edge of the widest part of foot 10 from heel point 34 at the base of the heel to the angle of curvature of the lateral edge of the widest part of foot 10 at heel point 34. Indeed, it is further preferable to accomplish the step of measuring the width of the heel of foot 10 as determined by the sidewall contact points, such as point 82 and point 83 shown in FIG. 6. In other words, the distance between sidewall contacts points 82,83 comprises heel width component 70. To obtain even further accuracy in sizing foot 10, a preferred step includes obtaining a foot volume measurement by measuring the peripheral distance from heel point 34 of foot 10 up to and around upper instep area 76 and then back down to heel point 34. This foot volume measurement thus comprises measuring the distance from heel point 34 to upper instep area 76 on both the medial and lateral sides of foot 10.

What is provided therefore is a method for generating a three dimensional surface from only a minimum number of measuring points or scalers. Although the Brannock system and other prior art foot measuring systems have attempted to achieve such a system, the results have been inaccurate and relational, rather than empirical. Indeed, applicant has identified a plurality of scaler relationships which very accurately define the shape and volume of a foot being measured. Although it is appreciated that other scaler relationships are contemplated within the scope of this invention, the disclosed measurement system accurately defines foot relationships well beyond that known in the art. For example, the volume measurement very accurately provides a swept area extending from the heel point to the instep region. The intersection of the volume measurement location at the instep region 76 provides an optimum slope location down towards the previously described T point. Indeed, that relationship discloses a number of substantially triangular shaped surface areas which more accurately define the fit of a foot within a shoe then would the conventional length and width measurements. However, the additional combination of measuring heel width and foot curvature related to a foot centerline provides additional substantial improvements over measuring systems in the past. By combining this valuable information with line II—II then the foot flexion dynamics are also accounted for to provide yet another key scaler or measurement. Thus, a system is provided to designate substantially unrelated scalers or measurements to describe a three dimensional surface so that a foot may be empirically measured rather than relationally measured as in prior art measurement systems. For example, any alteration in prior art length would probably effect the width measurement. By contrast, the present measuring system may hold a T point length measurement at one number while varying any of several other factors independent thereof.

Therefore, a method for sizing a foot is provided comprising the steps of axially measuring a length component, calculating a foot width line, and comparing the angle formed by the curvatures of the foot. More particularly, the step of axially measuring a length component comprises axially measuring a length component of a foot along a length axis on a foot centerline aligned between a heel point at the base of the heel to the tip of the second toe, with the measurement extending from the heel point to an intersection with a foot width measurement line. Next, a foot width line is calculated between the widest part of the foot at the first metatarsal head region and the widest part of the foot at the fifth metatarsal head region. Finally, a comparison is performed of the angles formed by the curvature of the medial edge of the foot from the first metatarsal head region to the heel point at the base of the heel with the angle formed by the curvature of the lateral edge of the foot from the fifth metatarsal head region to the heel point at the base of the heel. Additionally, a specific arch-line type of the foot being measured may be determined and a value assigned to that arch-line type from a plurality of arch-line types.

Alternately, a method for accurately sizing a foot utilizing a plurality of rapidly determinable foot scaler values is provided according to the present invention. The steps involve measuring a foot length scaler value, determining a foot heel width scaler value, and ascertaining a foot curvature scaler value. More particularly, the foot length scaler value is determined as the distance from a foot heel point to an intersecting foot width line. The foot length scaler value is measured along a straight line extending between the heel point, the center of mass of the heel, and the center point of the tip of the second toe. The intersecting foot width line comprises a straight line extending substantially between the foot first metatarsal head region and a foot fifth metatarsal head region. This foot width line may itself comprise a scaler value. Determination of a foot heel width scaler value is accomplished by determining the size of the straight line vector extending between the sides of the foot heel normally in contact with a surface being walked on. Also, ascertaining a foot curvature scaler value is accomplished by comparing the angle formed by the curvature of the medial edge of the foot from the first metatarsal head region to the heel point at the base of the heel with the angle formed by the curvature of the lateral edge of the foot from the fifth metatarsal head region to the heel point at the base of the heel. A foot volume scaler may also be provided to further enhance the value of the above-described scalers. The foot volume scaler value is derived by peripherally sizing the distance from the heel point up to and around a foot upper instep portion and then down along an opposite side of the foot to the heel point. Optionally, a toe distance scaler value is provided by measuring a distance from said foot width line to a preselected toe point. For example, a toe distance scaler value may be chosen comprising the distance between the T point along a foot centerline to the end of the tip of the second toe. This would normally be considered an optional scaler value because a shoe or last toe cap area would normally be designed based on style rather than unusually long or unusually shaped toes of a population. This of course permits use of modular lasts if desired. Thus, it may be seen that the small number of scaler values used by the present invention to describe the three dimensional foot surface describes substantially the entire foot surface at or behind the T point in a direction towards the heel point. Once again, therefore, one may see the inherent fallacy of measurement systems which rely virtually entirely on length of foot from a heel point to a toe. What has been determined by applicant is that numerous variables exist in defining a foot and that substantially all of those variables may be defined by using the scalers herein as measured from the T point towards the heel point. Further, as was earlier discussed, the scaler or measurements described herein may be individually altered independent of any effect on the related scalers or measurements. This a substantial difference over the prior art measurement systems.

In the manufacture of many types of footwear, a footwear last is utilized for shaping the footwear during the manufacturing process. Therefore, by improving the accuracy and efficiency of foot sizing, lasts constructed according to the improved measurement and sizing information method discussed above will provide improved footwear manufacture capabilities. Accordingly, as shown in FIG. 9, a last 100 for shaping footwear comprising an outer surface shape empirically derived from foot measurements according to the present foot sizing invention is also provided. A last derived from said foot measurements would comprise an axially measured length component as measured from a foot along a length axis aligned between a foot centerline I—I extending from a heel point 34 at the base of the heel to the tip of the second toe. The length component measurement would extend from the heel point to an intersection with a foot width measurement line II—II. A foot width component or line would shape the width of the last. A foot width component would be selected from one of a plurality of foot width lines on a foot being measured. The foot width component may be selected from a group of foot width component lines comprising a line extending between the widest part of the foot at the foot medial ball and the widest lateral part of the foot, a foot width line extending between the widest part of the foot at the foot medial flexion point and the widest lateral part of the foot at the lateral flexion point, and a foot width line extending between the foot first metatarsal head region and the foot fifth metatarsal head region. Also, a foot curvature component would be derived by comparing the angle of curvature of the medial edge of the widest part of the foot from the heel point at the base of the heel to the angle of curvature of the lateral edge of the widest part of the foot to the heel point. This foot curvature component would provide last curvature appropriately sized and shaped to provide footwear manufacture which is appropriate for the measured foot.

Additional empirical values used to shape an outer surface of a last for footwear manufacture comprises a heel width value and an internal volume value. The heel width value is either empirically matched to the measurement of a heel width of the measured foot or a modeled match is accomplished based on the actual measurement. The internal volume is defined as the volume within the last outer surface which is empirically derived by measuring the peripheral distance along a line extending from the heel point of the foot laterally up to the upper instep region 76 of the foot and then medially down to the heel point of the foot. This peripheral distance comprises a number related to a derived value for foot volume.

Although specific mechanical configurations have been illustrated and described for the preferred embodiments of the present invention set forth herein, it will be appreciated by those of ordinary skill in the art that other arrangements which are calculated to achieve the same purpose may be substituted for the specific configurations shown. Thus, while the present invention has been described in connection with the preferred embodiments thereof, it will be understood that many modifications will be readily apparent to those of ordinary skill in the art, and the disclosed configurations herein are intended to cover any adaptations or variations thereof. Therefore, it is manifestly intended that the inventive aspects described herein be limited only by the claims and the equivalents thereof. Accordingly, it is also understood that while certain embodiments of the present invention have been illustrated and described, the invention is not to be limited to the specific forms or arrangement of parts herein described-and shown.

What is claimed is:

1. A last for manufacturing footwear for a measured foot, the last constructed and arranged to have an outer footwear shaping surface comprising:

a) a length component;

b) a width component; and c) a curvature angle component;

wherein the length component, the width component, and the curvature angle component of the outer surface are derived from measurements of the measured foot;

wherein the length component corresponds to a foot length line of the foot measured along a foot centerline extending between a heel point at the base of the heel and the middle of the tip of the second toe, the foot length line extending from the heel point to an intersection with a foot width line;

wherein the width component corresponds to a foot width line of the foot measured along a line extending between the widest part of the foot at the first metatarsal head region and the widest part of the foot at the fifth metatarsal head region; and wherein the curvature angle component corresponds to: 1) a lateral curvature angle of the foot measured between the foot centerline and a line extending from the heel point to the widest part of the foot at the fifth metatarsal head region at the foot width line, and 2) a medial curvature angle of the foot measured between the foot centerline and a line extending from the heel point to the widest part of the foot at the first metatarsal head region at the foot width line.

2. The last of claim 1, wherein the outer footwear shaping surface of the last further includes an arch-line component, wherein the arch-line components is derived from measurements of the measured foot, wherein the arch-line component corresponds to an arch-line of the foot measured relative to the foot centerline.

3. The last of claim 2, wherein the outer footwear shaping surface of the last further includes a heel width component, wherein the heel width component is derived from measurements of the measured foot, wherein the heel width component corresonds to the distance between the sidewall contact points of the heel of the foot with a plannar surface.

4. The last of claim 3, wherein the outer footwear shaping surface of the last further includes a foot volume component corresponds to the peripheral distance measured from the heel point of the foot and extending up to and around the upper instep portion of the foot and back down to the heel point.

5. A last for manufacturing footwear to fit feet which have a known combination of dimensions including a foot length measured along a foot centerline extending between a heel point at the base of the heel and the middle of the tip of the second toe, the foot length extending from the heel point to an intersection point with a foot width; a foot width measured along a line from the widest part of the foot at the first metatarsal head region to the widest part of the foot at the fifth metatarsal head region; a lateral curvature angle measured between the foot centerline and a line extending from the heel point to the widest part of the foot at the fifth metatarsal head region at the foot width; and a medial curvature angle measured between the foot centerline and a line extending from the heel point to the widest part of the foot at the first metatarsal head region at the foot width;

the last having an outer footwear shaping surface constructed and arranged to have a combination of dimensions comprising:

a) a length component corresponding to said foot length of the foot;

b) a width component corresponding to said foot width of the foot;

c) a lateral curvature angle component corresponding to said lateral curvature angle of the foot; and d) a medial curvature angle component corresponding to said medial curvature angle of the foot.

6. The last of claim 5, wherein the outer footwear shaping surface of the last further includes an arch-line component corresponding to an arch-line of the foot, the arch-line of the foot measured relative to the foot centerline.

7. The last of claim 6, wherein the outer footwear shaping surface of the last further includes a heel width component corresponding to a distance measured between two sidewall contact points of the heel of the foot with a planar surface.

8. The last of claim 7, wherein the outer footwear shaping surface of the last further includes a foot volume component corresponding to a peripheral distance measured from the heel point of the foot up to and around an upper instep portion of the foot and back down to the heel point.

* * * * *

UNITED STATES PATENT AND TRADEMARK OFFICE

CERTIFICATE OF CORRECTION

PATENT NO. : 5,231,723

DATED : August 3, 1993

INVENTOR(S) : Jay P. White et al.

It is certified that error appears in the above-identified patent and that said Letters Patent is hereby corrected as shown below:

In claim 3, Column 10, line 7, DELETE "corresonds" and insert --corresponds--.

In claim 3, Column 10, line 9, DELETE "plannar" and insert --planar--.

In claim 4, Column 10, line 12, INSERT --,wherein the foot volume component is derived from measurements of the measured foot, wherein the foot volume component-- after the word "component".

Signed and Sealed this

Twenty-sixth Day of April, 1994

*Attest:*

Bruce Lehman

BRUCE LEHMAN

*Attesting Officer*

*Commissioner of Patents and Trademarks*